US010487653B2

(12) United States Patent
Debono

(10) Patent No.: US 10,487,653 B2
(45) Date of Patent: Nov. 26, 2019

(54) CLAMP ASSEMBLY

(71) Applicant: Milton Robert Debono, Pretoria (ZA)

(72) Inventor: Milton Robert Debono, Pretoria (ZA)

( * ) Notice: Subject to any disclaimer, the term of this patent is extended or adjusted under 35 U.S.C. 154(b) by 0 days.

(21) Appl. No.: 15/924,167

(22) Filed: Mar. 16, 2018

(65) Prior Publication Data

US 2018/0266248 A1 Sep. 20, 2018

(51) Int. Cl.

| | |
|---|---|
| ***E21D 20/00*** | (2006.01) |
| ***B25B 1/08*** | (2006.01) |
| ***B25B 1/24*** | (2006.01) |
| ***E21B 19/24*** | (2006.01) |

(52) U.S. Cl.

CPC ..... *E21D 20/00* (2013.01); *B25B 1/08* (2013.01); *B25B 1/2421* (2013.01); *E21B 19/24* (2013.01); *E21D 20/003* (2013.01)

(58) Field of Classification Search

CPC ..... E21D 20/003; E21D 20/006; E21D 21/00; E21D 21/0093; B25B 1/08; B25B 1/14; B25B 1/2421

USPC ..... 405/259.1, 302.1; 269/228, 32, 229

See application file for complete search history.

(56) References Cited

U.S. PATENT DOCUMENTS 2,850,926 A * 9/1958 Jobe ..... B23Q 3/08 269/157
3,842,610 A * 10/1974 Willis ..... E21D 20/003 173/192
4,226,559 A * 10/1980 Prebensen ..... E21B 7/025 173/184
4,294,444 A * 10/1981 Horton ..... B25B 1/08 269/156
4,311,347 A * 1/1982 Cobb ..... E21D 20/003 173/188
4,473,325 A * 9/1984 Beney ..... E21D 20/006 173/185
4,832,536 A * 5/1989 Spross ..... E21D 20/003 173/184
5,114,279 A * 5/1992 Bjerngren ..... E21D 20/006 405/259.1
5,791,822 A * 8/1998 Edmondson ..... E21D 20/006 405/259.1
5,795,107 A * 8/1998 Edmondson ..... E21B 19/20 29/810
6,030,151 A * 2/2000 Woolnough ..... E21D 20/003 405/259.6

(Continued)

FOREIGN PATENT DOCUMENTS

CH 634760 A5 * 2/1983 ..... B21D 41/00

*Primary Examiner* — Frederick L Lagman

(74) *Attorney, Agent, or Firm* — Sheppard, Mullin, Richter & Hampton LLP

(57) ABSTRACT

This invention relates to a clamp assembly for clamping an elongate member such as a roof bolt, drill rod and the like, the clamp assembly comprising a housing having a receiving zone/gap for receiving the elongate member; a first jaw and a second jaw accommodated within the housing, wherein at least one of the first and second jaws being moveable within the housing between an opened position for allowing the drill rod to be received through the gap and between the first and second jaws, and a closed position for clamping the drill rod that is received in the gap between the first and second jaws; and an actuator for displacing at least one of the first and second jaws between the opened and closed positions.

12 Claims, 4 Drawing Sheets

(56) References Cited

U.S. PATENT DOCUMENTS

| | | | | |
|---|---|---|---|---|
| 6,115,898 | A * | 9/2000 | Sawdon | B25B 5/087 269/233 |
| 6,135,674 | A * | 10/2000 | Neilson | E21D 20/006 211/70 |
| 6,666,489 | B2 * | 12/2003 | Kruger | B25B 5/087 269/229 |
| 7,234,376 | B2 * | 6/2007 | Bader | B23P 19/006 269/233 |
| 7,607,866 | B2 * | 10/2009 | Eddowes | E21B 19/086 211/70 |
| 9,440,318 | B1 * | 9/2016 | Tibbets | B25B 27/02 |
| 2003/0205411 | A1 * | 11/2003 | Pierce | E21B 19/24 175/58 |
| 2006/0278419 | A1 * | 12/2006 | Hinshaw | E21D 20/006 173/184 |
| 2010/0266346 | A1 * | 10/2010 | Eddowes | B65H 51/10 405/259.1 |
| 2011/0048808 | A1 * | 3/2011 | Nystrom | E21B 7/025 175/203 |
| 2015/0117961 | A1 * | 4/2015 | Olsson | E21B 19/20 405/259.1 |
| 2017/0183966 | A1 * | 6/2017 | Wilson | E21D 20/003 |

* cited by examiner

CLAMP ASSEMBLY

CROSS-REFERENCE TO RELATED APPLICATIONS

This application claims priority to South African provisional application no. 2017/01895, filed 17 Mar. 2017 with Title, "Claim Assembly", which is hereby incorporated herein by reference in the respective entirety of each.

FIELD OF THE INVENTION

This invention relates generally to a clamp assembly for drill rods and roof bolts used in underground mining, wherein the drill rod is advanced and/or retracted to enable roof bolts to be fastened into an underground roofing structure.

BACKGROUND TO THE INVENTION

Underground mining of mineral ores, such as coal and hard and soft rock mining requires the widespread use of drilling. Roof bolting is a practical method employed in most coal and other mines. Roof bolts are used in underground mining operations to anchor a tunnel roof, thus preventing it from falling. This is achieved by first drilling a suitably sized hole into the roof that penetrates several rock layers. A ribbed rod covered with resin is inserted into the hole while a washer/nut assembly remains on the outside. The tensile strength of the rod prevents the roof from collapsing. Clamp assemblies are commonly used to guide drill rods and roof bolts in underground mines in order to prevent a whipping action when drilling into roof strata.

Clamp assemblies commonly used in the art comprise clamp arms which in an open position are configured to receive a roof bolt or drill rod. As an operator advances the drill rod or roof bolt between the clamp arms, their fingers may get caught between the exposed clamp arms, potentially resulting in serious injury to the operator.

A clamp assembly having clamp arms which are enclosed in a housing is therefore advantageous as it protects an operator from potentially serious injury and prevents whipping action.

SUMMARY OF THE INVENTION

According to a first aspect of the invention, there is provided a clamp assembly for clamping an elongate member such as a roof bolt, drill rod, and the like, the clamp assembly comprising:

- a housing having a receiving zone/gap for receiving the elongate member;
- a first jaw and a second jaw accommodated within the housing, with at least one of the first and second jaws being moveable within the housing between an opened position for allowing the elongate member to be received through the gap and between the first and second jaws, and a closed position for clamping the elongate member that is received in the gap between the first and second jaws; and
- an actuator for displacing at least one of the first and second jaws between the opened and closed positions.

In an embodiment, the housing may comprises a base arrangement and an overlying slide arrangement, the base and slide arrangements being slidably movable relative to each other.

In an embodiment, a cam body may be accommodated within the housing, the cam body may define a channel.

In an embodiment, the first jaw may be fixed within the housing and may be movable relative to the cam body when the base and slide arrangements move relative to each other.

In an embodiment, the second jaw may be pivotally accommodated within the housing and may have a proximal end and a distal end, with the distal end including a cam follower arranged to travel in the channel of the cam body, the second jaw being movable relative to the cam body, in unison with the first jaw, when the base and slide arrangements move relative to each other, with the channel being arranged so that when the housing moves from the retracted position to the extended position, under the action of the actuator, the second jaw pivots between an opened position, in which the proximal end of the second jaw is spaced apart from the first jaw, to a closed position, in which the proximal end of the second jaw is pivoted towards the first jaw, in order to clamp the elongate member between the first and second jaws.

In an embodiment, the cam body is secured to a base plate of the base arrangement, and the first and second jaws are secured to a platform plate provided on the slide arrangement.

In an embodiment, the actuator comprises a hydraulic cylinder and movable piston, with the hydraulic cylinder comprising a fixed end secured to the base plate of the base arrangement, and the end of the movable piston is secured to the platform plate provided on the slide arrangement.

In an embodiment, the channel defines a first elongate portion that is parallel to the actuator and a transversely extending second elongate portion that extends toward a side edge of the housing.

In an embodiment, the second jaw defines:

- a central portion that accommodates a pivot pin that is secured to the platform plate, to facilitate the pivoting action;
- a proximal portion that defines the proximal end of the second jaw; and
- a distal portion that defines the distal end of the second jaw, the distal portion including a pair of spaced apart arms with the cam follower, typically in the form of a roller, extending across the ends of the spaced apart arms, the cam follower thus being slidably accommodated within the channel.

In an embodiment of the invention, the tips of the jaws define an aperture so that in the closed position, the adjacent apertures can clamp a body in the form of an elongate member that extends perpendicular to the housing.

In an embodiment, the slide arrangement includes a pair of curved side walls, with the ends of the side walls, proximate the first and second jaws, defining a gap to enable the elongate body to be clamped by the jaws.

In an embodiment, the base and slide arrangements include complementary guide formations to enable them to slide relative to each other.

In an embodiment, the slide arrangement includes a cover to enclose the slide arrangement.

According to a second aspect of the invention there is provided a cam body arrangement for a clamp assembly for clamping an elongate member, the cam body arrangement comprising:

- a cam body defining a channel; and
- a jaw defining a proximal end and a distal end, with the distal end including a cam follower arranged to travel in the channel of the cam body.

In an embodiment, the channel defines a first elongate portion and a transversely extending second elongate portion that extends toward a side edge of the cam body.

In an embodiment, the jaw defines:

a central portion that accommodates a pivot pin to facilitate a pivoting action;

a proximal portion that defines the proximal end of the jaw; and a distal portion that defines the distal end of the jaw, the distal portion including a pair of spaced apart arms with the cam follower, typically in the form of a roller, extending across the ends of the spaced apart arms, the cam follower thus being slidably accommodated within the channel.

BRIEF DESCRIPTION OF THE DRAWINGS

The invention will be described, by way of example only, with reference to the accompanying drawings in which.

DESCRIPTION OF A PREFERRED EMBODIMENT

Figure 1:
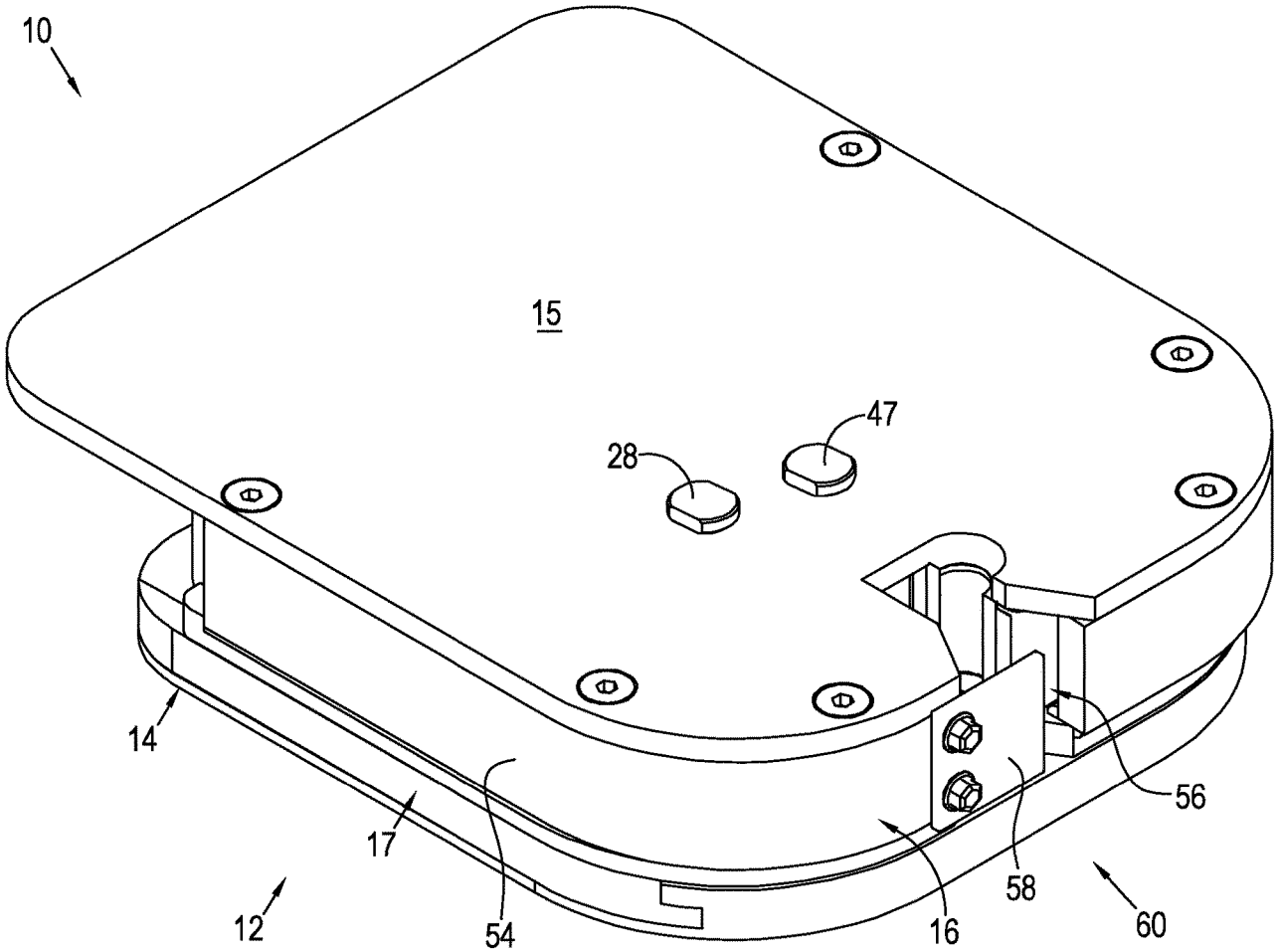
FIG. 1 shows a perspective view of a clamp assembly of the invention, in a retracted, opened position.

Referring to the drawings, a clamp assembly 10 for clamping an elongate member, such as a drill rod or roof bolt, is shown.

The clamp assembly 10 comprises a housing 12 comprising a base arrangement 14 and a spaced apart, overlying slide arrangement 16. The slide arrangement 16 is typically fitted with a cover 15 to enclose the slide arrangement 16.

Figure 3:
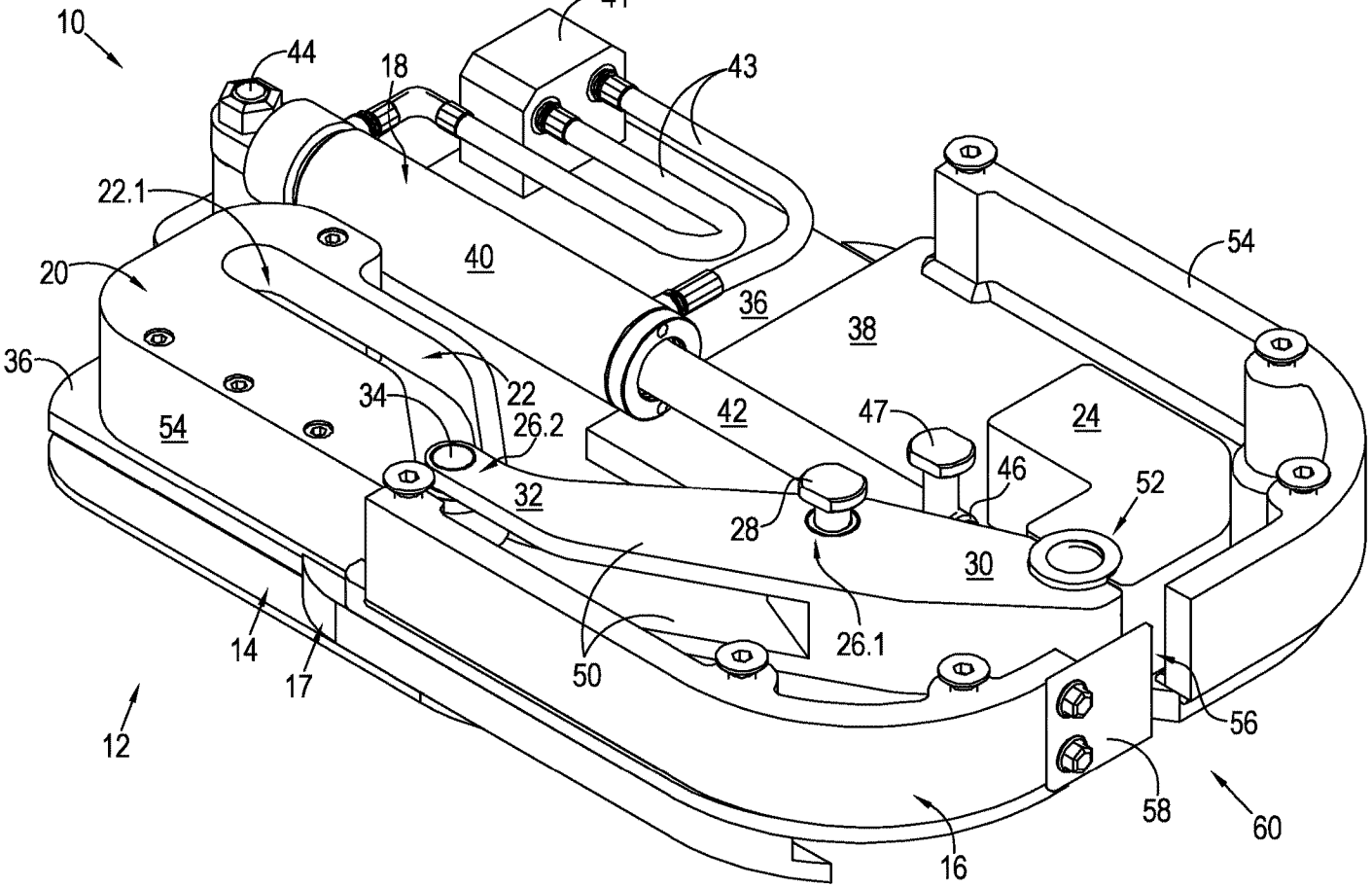
FIG. 3 shows a perspective view of the clamp assembly of the invention, similar to FIG. 1, but with a lid of the clamp assembly being removed, and the assembly being shown in the extended, closed position.

The base and slide arrangements 14, 16 are slidably movable relative to each other, as best shown when comparing FIGS. 1 and 3. The base and slide arrangements 14, 16 include complementary guide formations 17 to enable them to slide relative to each other.

Figure 2:
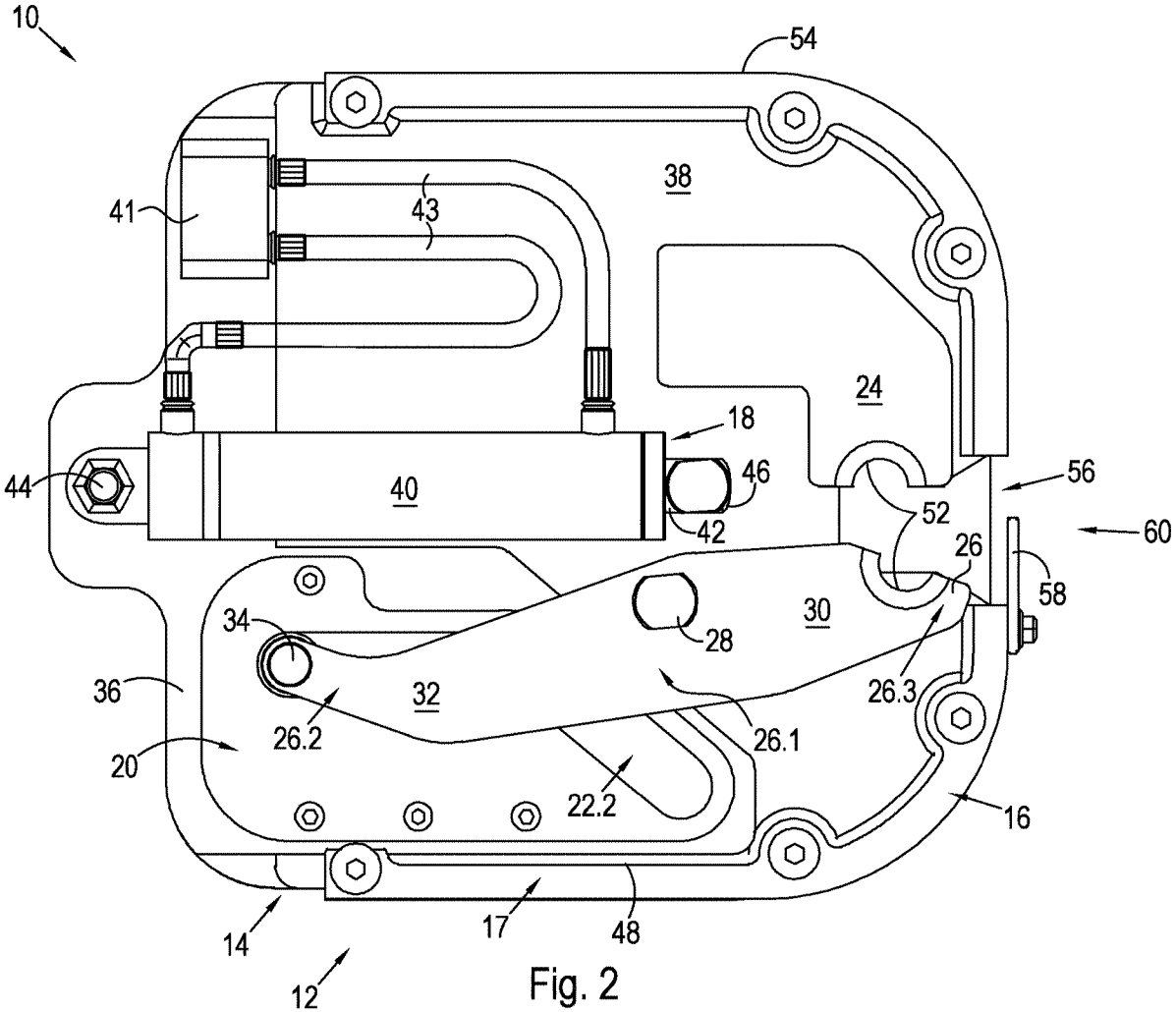
FIG. 2 shows a top view of the clamp assembly shown in FIG. 1, but with a lid of the clamp assembly being removed.
Figure 4:
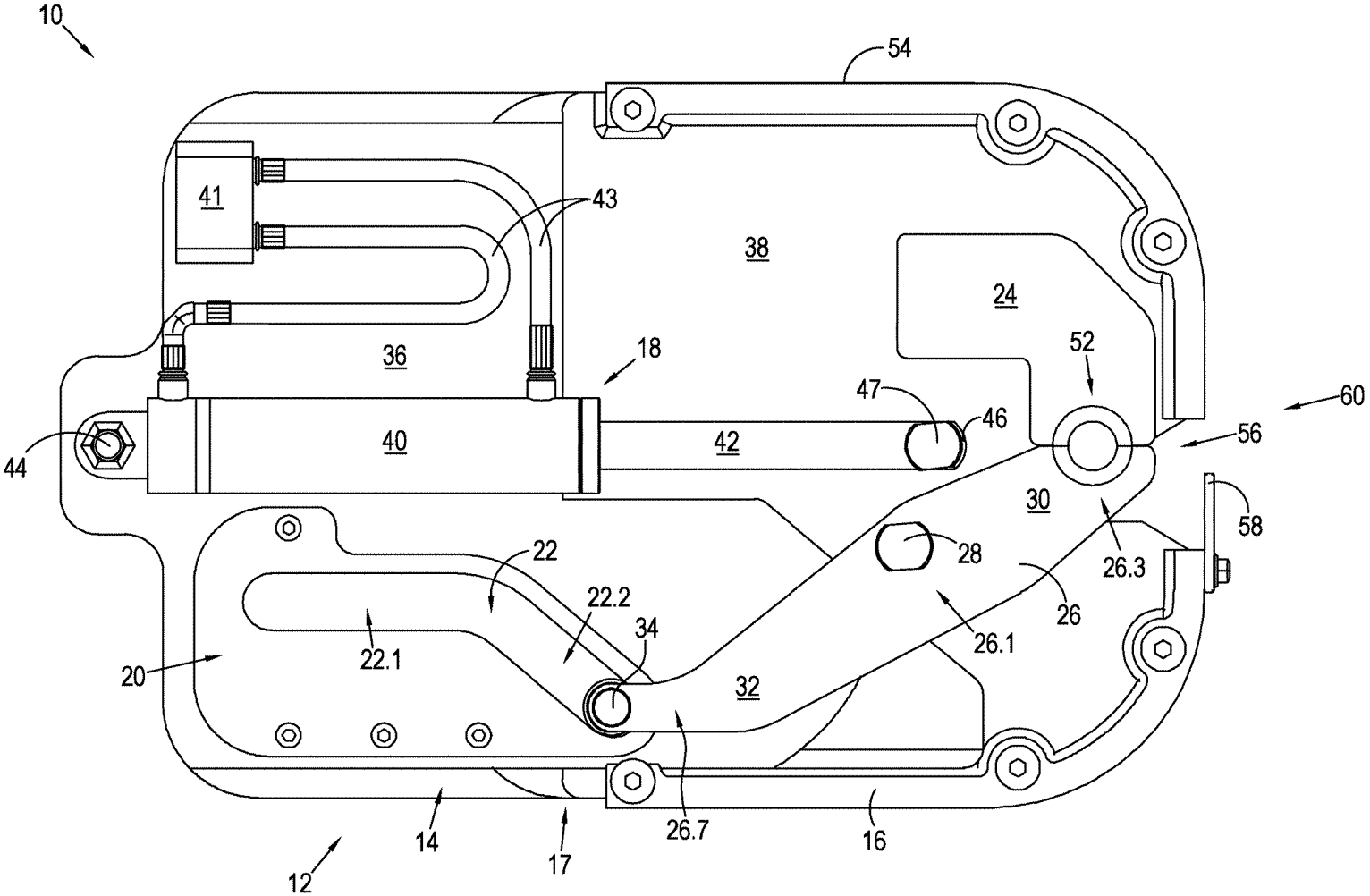
FIG. 4 shows a top view of a clamp assembly of FIG. 3.

The sliding action between the base and slide arrangements 14, 16, relative to each other, is controlled by an actuator 18, as shown in FIGS. 2 to 4. The actuator 18 causes the clamp assembly 10 to move between a retracted, opened position (as shown in FIG. 2) and an extended, closed position (as shown in FIGS. 3 and 4).

The clamp assembly 10 further comprises a cam body 20 accommodated within the housing 12, the cam body 20 defining a channel 22.

A first jaw 24 is accommodated within the housing 12, the first jaw 24 being movable relative to the cam body 20 when the base and slide arrangements 14, 16 move relative to each other.

A second jaw 26 is pivotally accommodated (by means of a pivot pin 28, which protrudes through the cover 15) within the housing 12 and defines a proximal end 30 and a distal end 32, as best shown in FIGS. 2 to 4. The distal end 32 includes a cam follower 34, with the second jaw 26 also being movable relative to the cam body 20, in unison with the first jaw 24, when the base and slide arrangements 14, 16 move relative to each other.

The cam follower 34 is arranged to travel within the channel 22, with the channel 22 being arranged so that when the housing 12 moves from the retracted position (FIGS. 1 and 2) to the extended position (FIGS. 3 and 4), under the action of the actuator 18, the second jaw 26 pivots between an opened position, in which the proximal end 30 of the second jaw 26 is spaced apart from the first jaw 24, to a closed position, in which the proximal end 30 of the second jaw 26 is pivoted towards the first jaw 24, in order to clamp the drill rod or roof bolt body between the first and second jaws 24, 26.

In an embodiment, the cam body 20 is secured to a base plate 36 of the base arrangement 14, and the first and second jaws 24, 26 are secured to a platform plate 38 provided on the slide arrangement 16.

The actuator 18, with reference to FIGS. 2 to 4, typically comprises a hydraulic cylinder 40 and movable piston 42. The hydraulic cylinder 40 comprises a fixed end 44 secured to the base plate 36 of the base arrangement 14, and the end 46 of the movable piston 42 is secured to both the platform plate 38 provided on the slide arrangement 16 and the cover 15 of the slide arrangement 16 by means of a connector pin 47 that is only shown as extending through the cover 15. The actuator 18 further comprises a fluid reservoir 41 for containing fluid for use by the cylinder 40 in displacing the piston 42 to displace the slide arrangement 16 relative to the base 14 between the retracted and extended positions. The actuator further comprise a closed loop of fluid lines 43 for supplying fluid to the cylinder 40.

Typically, the channel 22 defines a first elongate portion 22.1 that is parallel to the actuator 18, and a transversely extending second elongate portion 22.2 that extends toward a side edge 48 of the housing 12, as best seen in FIG. 2 of the drawings.

In an embodiment, the second jaw 26 defines a central portion 26.1 that accommodates the pivot pin 28 that is secured to the platform plate 38, to facilitate the pivoting action. The second jaw 26 further defines a distal portion 26.2 that defines the distal end 32 of the second jaw 26, and a proximal portion 26.3 that defines the proximal end 30 of the second jaw 26, as best shown in FIGS. 2 and 4 of the drawings. The distal portion 26.2 includes a pair of spaced apart arms 50 with the cam follower 34 extending across the ends of the spaced apart arms 50, the cam follower 34 thus being slidably accommodated within the channel 22.

The tips of the jaws 24, 26 define notches 52, as shown in FIG. 2 of the drawings, so that in the closed position, the adjacent notches 52 can clamp the elongate drill rod or roof bolt, which would typically extend perpendicular to the housing 12.

In an embodiment, the slide arrangement 16 includes a pair of curved side walls 54, with the ends of the side walls, proximate the first and second jaws 24, 26, defining a gap/receiving zone 56 to enable the elongate drill rod to be clamped by the jaws 24, 26.

In an embodiment, a closure member 58 is removably connected to one of the ends of the side walls, and is arranged ahead of the gap 56 so as to partly cover the gap 56 at a front end 60 of the housing 12.

A clamp assembly 10 allows an operator to guide a drill rod (not shown) while drilling a hole into roof strata, and to insert a roof bolt (not shown) into the hole. In use, once a hole has been drilled into the roof strata to the required depth, the drill rod and clamp assembly 10 are retracted, and the drill rod is removed from the clamp assembly 10. A roof bolt having a washer attached thereto (not shown) is received by the jaws 24, 26. The roof bolt is inserted into the drilled hole and once it is inserted to approximately half its length, the jaws 24, 26 are moved by the actuator 18 from the closed position to the opened position such that the roof bolt and its washer may pass through the jaws 24, 26 and into the roof strata. The jaws 24, 26 are located within the housing 12 thus preventing operators from injuring their fingers and hands when opening and closing the jaws 24, 26 to receive or retract a drill rod or roof bolt.

What is claimed is:

1. A clamp assembly for clamping an elongate member comprising:

a housing defining a receiving gap for receiving the elongate member;

a first jaw and a second jaw enclosed within the housing, wherein at least one of the first and second jaws being moveable within the housing between an opened position for allowing the elongate member to be received within the gap of the housing and between the first and second jaws, and a closed position for clamping the elongate member that is received within the gap of the housing between the first and second jaws; and an actuator for displacing at least one of the first and second jaws between the opened and closed positions;

wherein the housing comprises a base arrangement and an overlying slide arrangement, wherein the actuator slidably moves the base and slide arrangements relative to each other, between a retracted position and an extended position so as to move at least one of the first and second jaws between the opened and closed positions, respectively.

2. The clamp assembly according to claim 1, comprising a cam body that is secured to the base arrangement of the housing, the cam body defining a channel.

3. The clamp assembly according to claim 2, wherein the first jaw is fixed within the housing and movable relative to the cam body when the base and slide arrangements slide relative to each other.

4. The clamp assembly according to claim 2, wherein the second jaw is pivotally accommodated within the housing and has a proximal end and a distal end, with the distal end including a cam follower arranged to travel in the channel of the cam body, the second jaw being movable relative to the cam body, in unison with the first jaw, when the base and slide arrangements move relative to each other, with the channel being arranged so that when the housing moves from the retracted position to the extended position, under the action of the actuator, the second jaw pivots between an opened position, in which the proximal end of the second jaw is spaced apart from the first jaw, to a closed position, in which the proximal end of the second jaw is pivoted towards the first jaw, in order to clamp the elongate member between the first and second jaws.

5. The clamp assembly according to claim 4, wherein the cam body is secured to a base plate of the base arrangement, and the first and second jaws are secured to a platform plate provided on the slide arrangement.

6. The clamp assembly according to claim 5, wherein the actuator comprises a hydraulic cylinder and movable piston, with the hydraulic cylinder comprising a fixed end secured to the base plate of the base arrangement, and the end of the movable piston is secured to the platform plate provided on the slide arrangement.

7. The clamp assembly according to claim 5, wherein the second jaw defines:

a central portion that accommodates a pivot pin that is secured to the platform plate, to facilitate the pivoting action;

a proximal portion that defines the proximal end of the second jaw; and a distal portion that defines the distal end of the second jaw, the distal portion including a pair of spaced apart arms with the cam follower extending across the ends of the spaced apart arms, the cam follower thus being slidably accommodated within the channel.

8. The clamp assembly according to claim 2, wherein the channel defines a first elongate portion that is parallel to the actuator and a transversely extending second elongate portion that extends toward a side edge of the housing.

9. The clamp assembly according to claim 1, wherein the tips of the jaws define an aperture so that in the closed position, the adjacent apertures clamp the elongate member that extends perpendicular to the housing.

10. The clamp assembly according to claim 1, wherein the slide arrangement includes a pair of curved side walls, with the ends of the side walls, proximate the first and second jaws, defining the receiving gap of the housing to enable the elongate member to be clamped by the jaws.

11. The clamp assembly according to claim 1, wherein the base and slide arrangements include complementary guide formations to enable them to slide relative to each other.

12. The clamp assembly according to claim 1, wherein the slide arrangement includes a cover to enclose the slide arrangement.

* * * * *